United States Patent [19]

Torrey

[11] 4,028,520

[45] June 7, 1977

[54] AIR FLOW SYSTEM FOR COMMON CAVITY MICROWAVE OVEN

[75] Inventor: Sumner H. Torrey, West Lafayette, Ind.

[73] Assignee: Roper Corporation, Kankakee, Ill.

[22] Filed: Feb. 26, 1976

[21] Appl. No.: 661,524

[52] U.S. Cl. ..... 219/10.55 B; 219/10.55 F

[51] Int. Cl.[2] ..... H05B 9/06

[58] Field of Search ..... 219/10.55 B, 10.55 F, 219/10.55 R; 126/273 R, 19 R; 343/731, 732, 741, 772, 879

[56] References Cited

UNITED STATES PATENTS

| | | | |
|---|---|---|---|
| 2,860,026 | 11/1958 | Long | 219/10.55 B |
| 2,961,520 | 11/1960 | Long | 219/10.55 F |
| 3,172,987 | 3/1965 | Fitzmayer | 219/10.55 B |
| 3,367,316 | 2/1968 | Eff | 126/273 R |
| 3,470,942 | 10/1969 | Fukada et al. | 219/10.55 B |
| 3,626,135 | 12/1971 | Fitzmayer | 219/10.55 F |
| 3,962,561 | 6/1976 | Maitenaz | 126/19 R |

*Primary Examiner*—Arthur T. Grimley

*Attorney, Agent, or Firm*—Leydig, Voit, Osann, Mayer & Holt, Ltd.

[57] ABSTRACT

A combined microwave-thermal range having an oven cavity with a thermal heating element for baking and self-cleaning purposes, the bottom wall of the oven cavity having an inlet opening and the top wall having a vent opening. A microwave module mounted in space provided under the bottom wall of the cavity includes a microwave power supply housing enclosing a magnetron and blower. The module has an associated waveguide secured to the top of the housing and extending cantilever-fashion close to the bottom wall of the cavity, with the outlet of the waveguide in alinement with the central opening couples microwave energy from the waveguide to the cavity. Blower air passes from the blower inlet through the magnetron and waveguide and into the cavity for ventilating the same. The blower inlet is located at a level below the bottom wall of the cavity so that, when the blower and magnetron are turned off and the thermal element is turned on, air passing through the blower, power supply housing and waveguide flows upwardly by natural convection into the opening in the bottom wall of the cavity with final escape through the vent at the top of the cavity.

7 Claims, 16 Drawing Figures

Fig. 4.
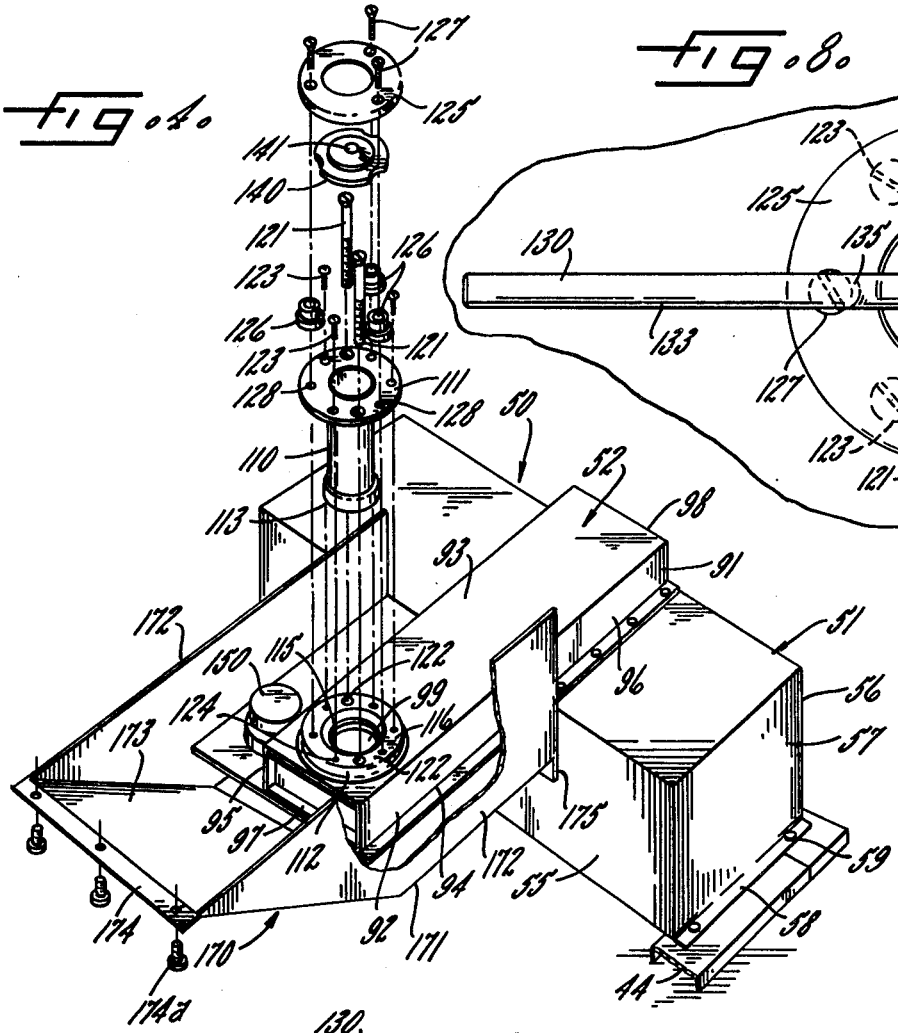
Fig. 8.
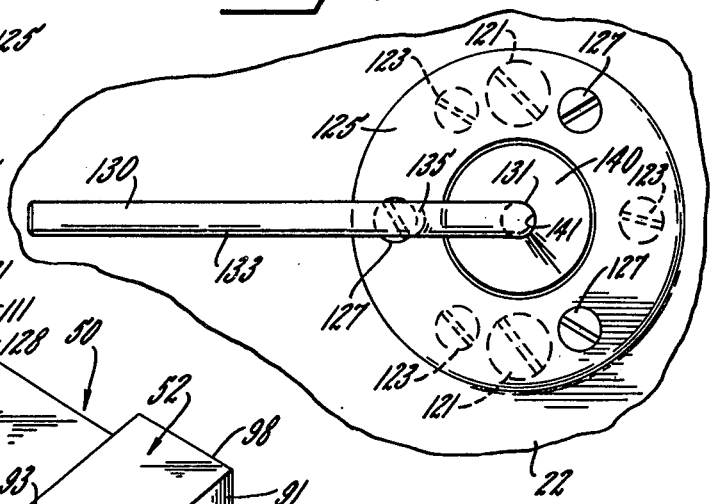
Fig. 6.
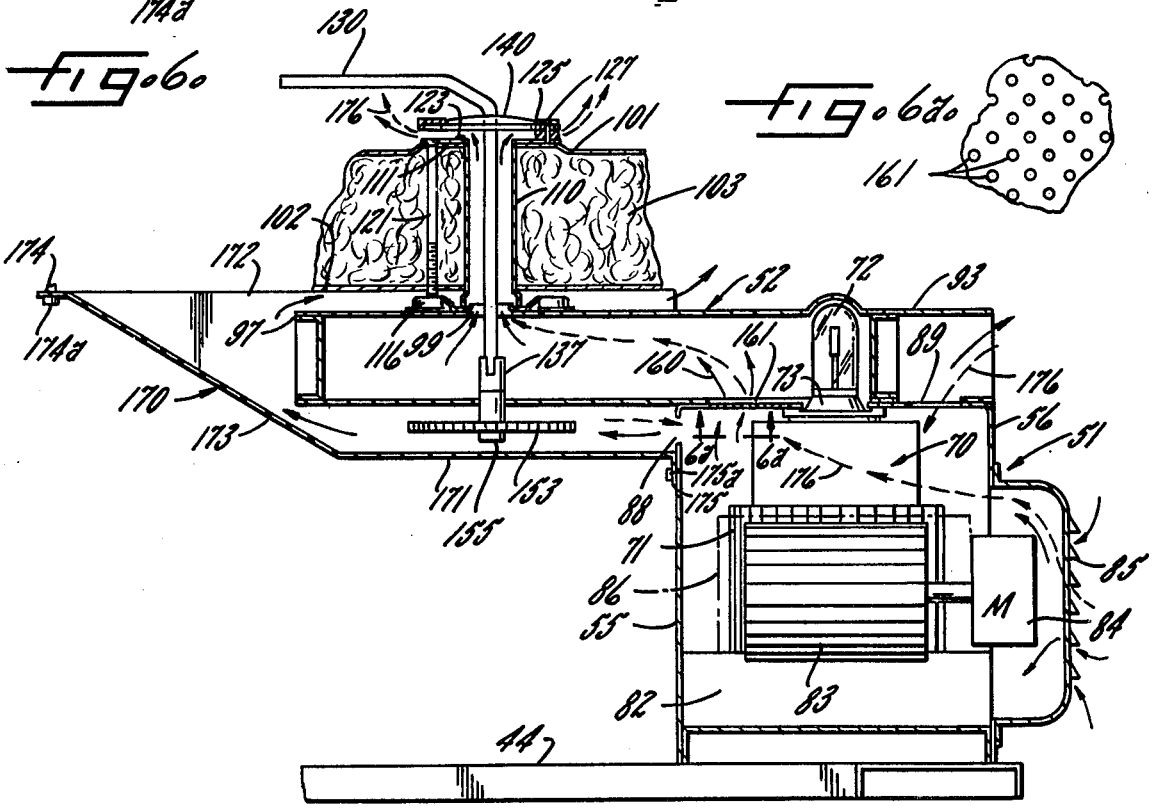
Fig. 6a.

AIR FLOW SYSTEM FOR COMMON CAVITY MICROWAVE OVEN

BACKGROUND OF THE INVENTION

For a number of years oven cavities have been employed for both thermal cooking and microwave cooking, as evidenced by Boehm U.S. Pat. No. 3,440,386 and French Pat No. 1,249,130. However, such structures present practical problems where operated in three modes namely microwave, thermal and self-clean. Thus when the temperature in the cavity is raised to a level, on the order of 900° F., capable of producing thermal decomposition of the soil on the cavity surfaces, a slightly positive pressure is created causing back-up of the heated air and volatile decomposition products into the waveguide where condensation takes place, resulting in an accumulation, or build up, of sticky residue which not only serves to contaminate the air subsequently flowing through the waveguide during normal cookery, but which can affect the transmission characteristics of the waveguide. Such accumulation is extremely difficult to remove, requiring substantially complete disassembly of the power supply housing and waveguide.

It is, accordingly, an object of the present invention to provide a common cavity oven capable of microwave and thermal cookery and which is in addition capable of positively and reliably expelling the decomposition products when operated at high temperature in a self-clean mode. It is a related object of the present invention to provide a common cavity oven which is sealed against escape of microwave energy when operated in the microwave mode but which nevertheless has good ventilation characteristics when operated in the thermal and self-clean modes, insuring a well defined and unidirectional ventilation path regardless of the operating temperature and which prevents backflow of the air and volatile products of decomposition into the inlet opening regardless of the temperature achieved within the cavity.

It is a more specific object to provide a ventilation system which is capable of resisting auto ignition pressures of the products of decomposition and in which unidirectional flow of ventilating air is assured even in the presence of severe soil.

It is yet another object to provide a ventilation scheme for a single cavity oven which is capable of operating in the self-clean mode but which is simple and economical avoiding use of screens, restrictions and the like which have been resorted to in prior structures in order to insure against backflow of contaminated air.

It is a general object to provide a ventilating system for a common cavity oven usable in all three modes of operation and which is safe in all three of the modes and which runs no risk of violent explosion of the products of combustion in the self-clean mode.

Other objects and advantages of the invention will become apparent upon reading the attached detailed description and upon reference to the drawings in which.

Figure 2A:
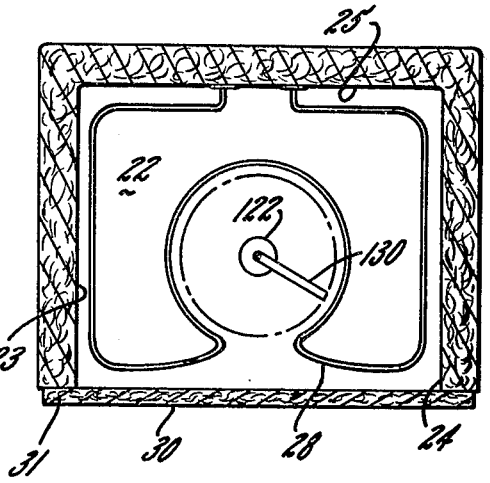
FIG. 2 is a vertical cross section looking along the line 2—2 in FIG. 1.
Figure 2:
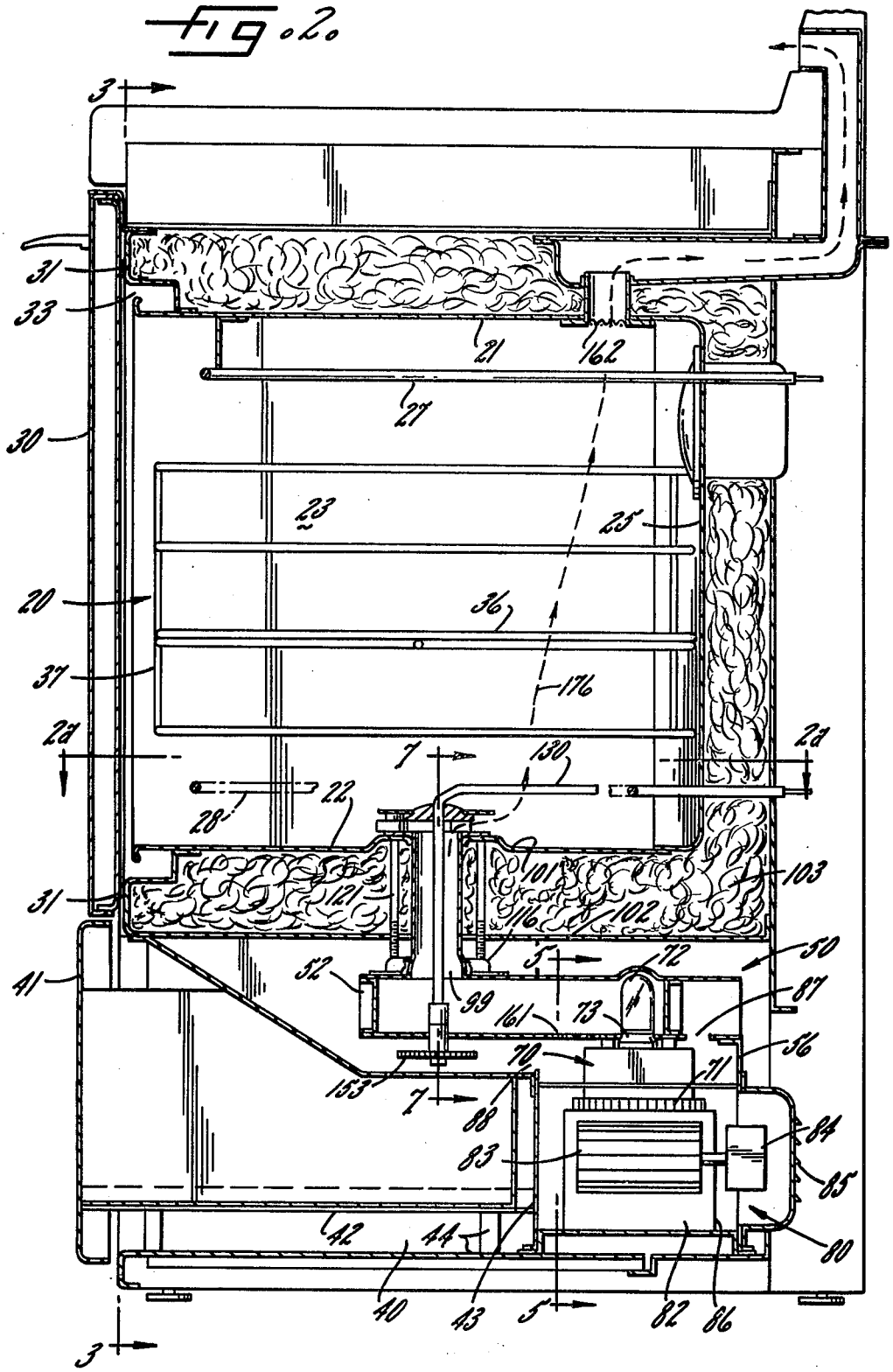

FIG. 2*a* shows the relation between the antenna and heating element looking along the line 2*a*—2*a* in FIG. 2.

Figure 1:
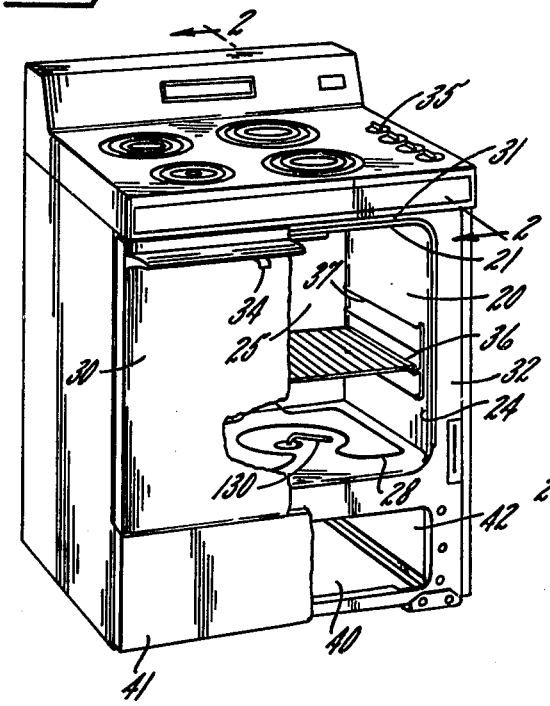
FIG. 1 is a perspective view of a free standing electric range of conventional design but incorporating a source of microwave energy and having provision for use of thermal and microwave energy simultaneously in a common oven cavity.
Figure 3:
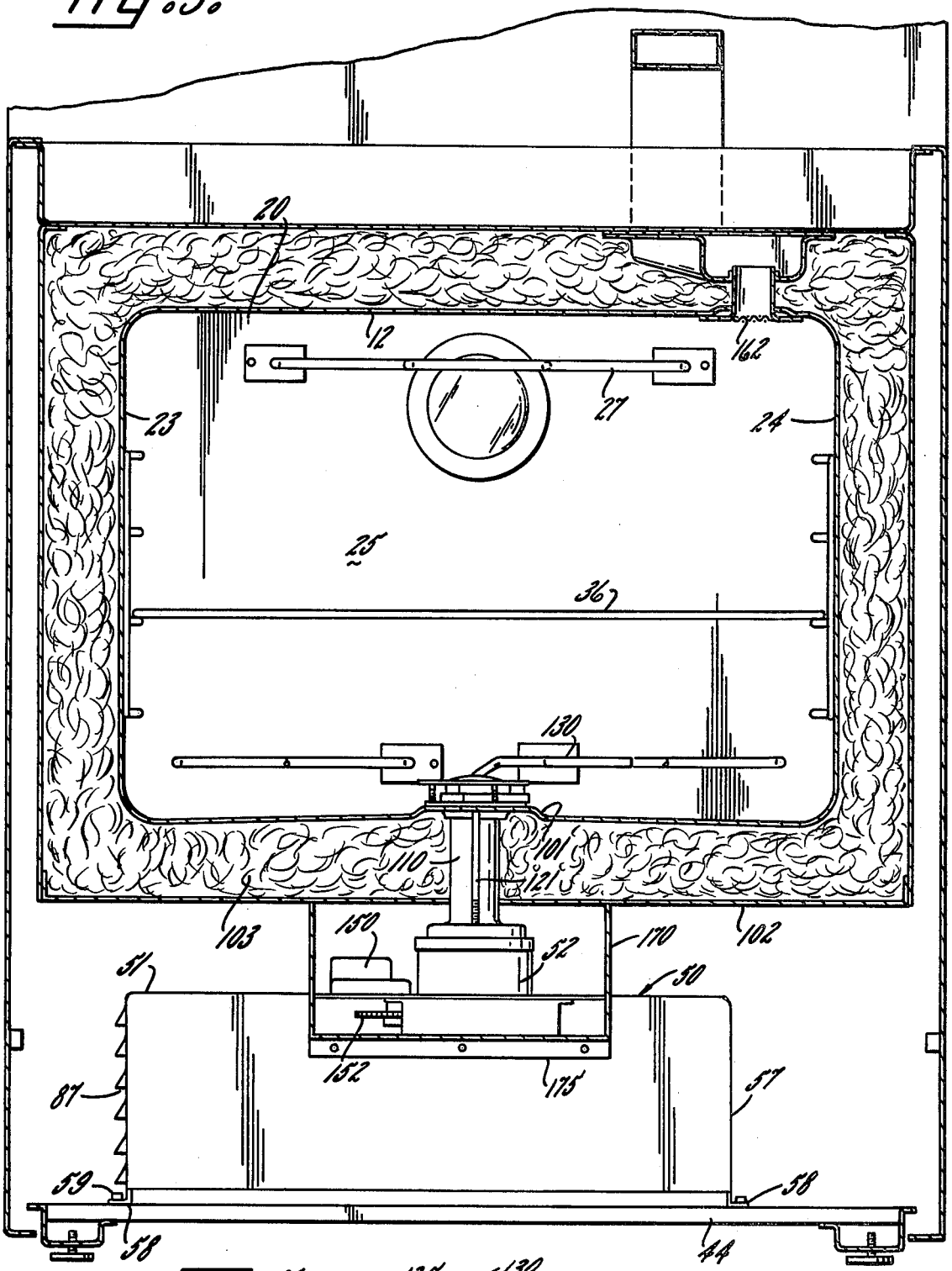

FIG. 3 is a front view of the oven of FIG. 1 with the door and drawer removed and looking along the line 3—3 in FIG. 2.

FIG. 4 is a perspective view of a microwave module constructed in accordance with the present invention.

Figure 5:
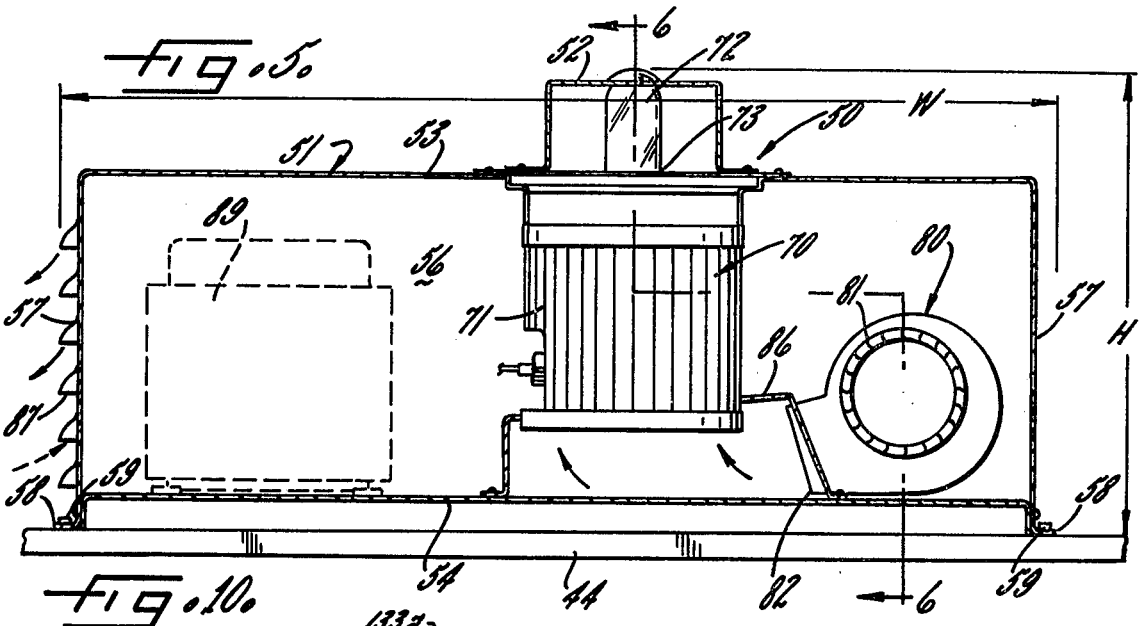

FIG. 5 is a vertical section taken through the microwave module, with the front wall removed, and looking along line 5—5 in FIG. 2.

FIG. 6 is a transverse section taken through the module looking along the line 6—6 in FIG. 5.

FIG. 6*a* is a fragment taken along line 6*a*—6*a* in FIG. 6.

Figure 7A:
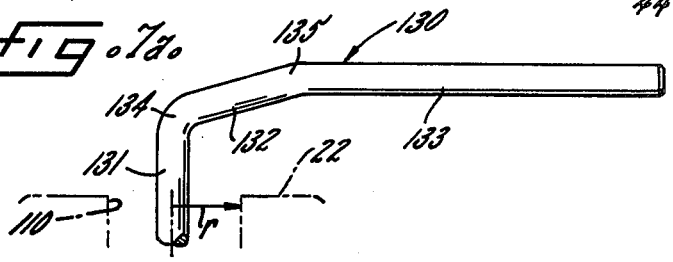
Figure 7:
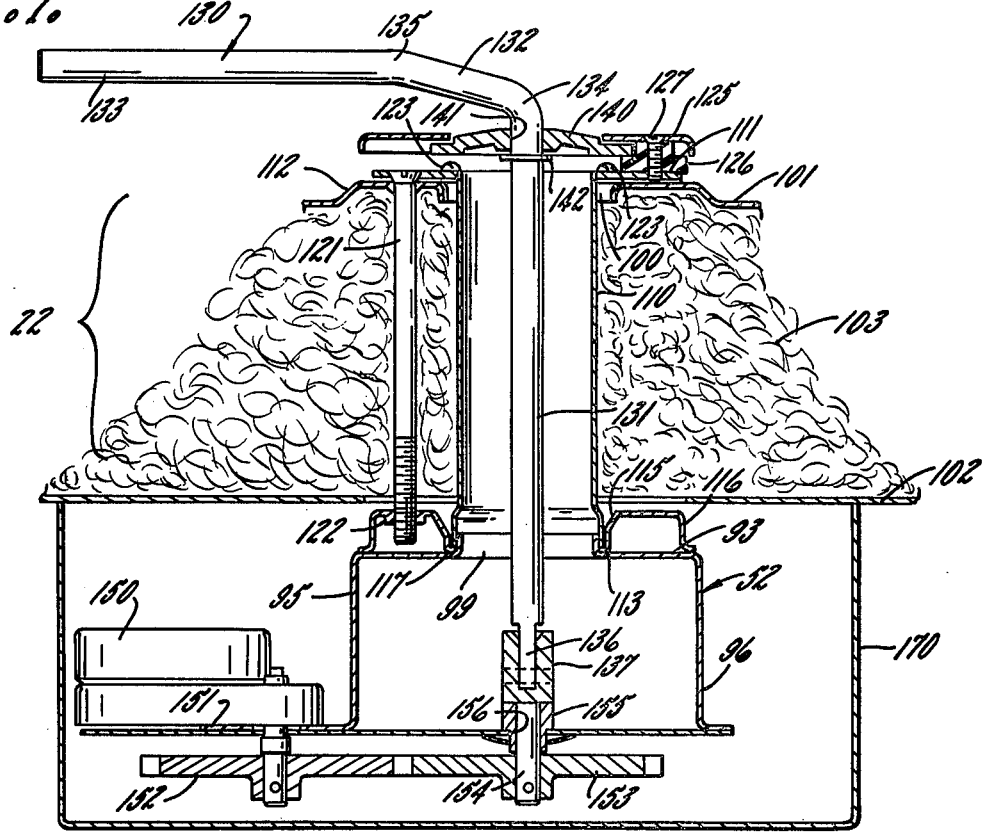

FIG. 7 is a cross sectional view through the hollow conductor and antenna assembly looking along the line 7—7 in FIG. 2.

FIG. 7*a* is a profile view of the antenna in FIG. 7.

FIG. 8 is a top view of the antenna looking along line 8—8 in FIG. 7.

Figure 9:
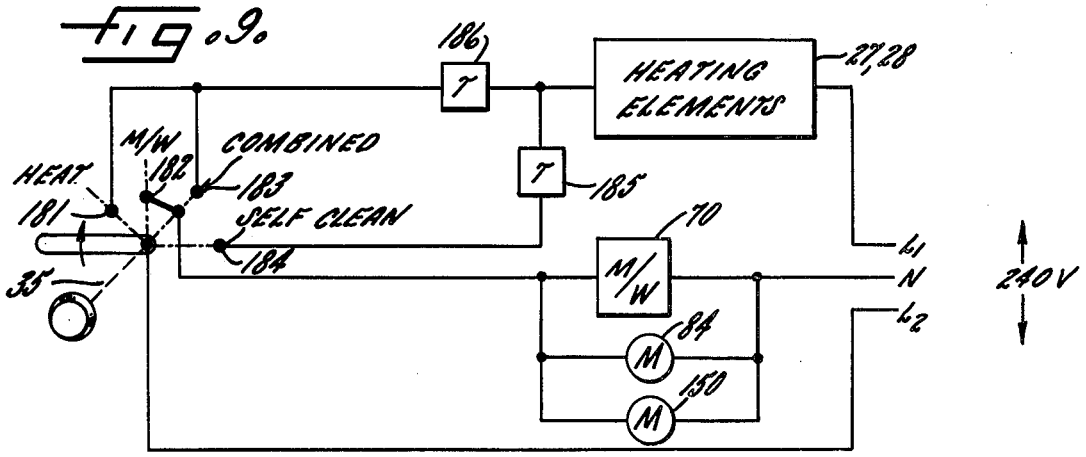

FIG. 9 is a schematic diagram of a control circuit permitting three modes of cookery plus self-cleaning.

Figure 10:
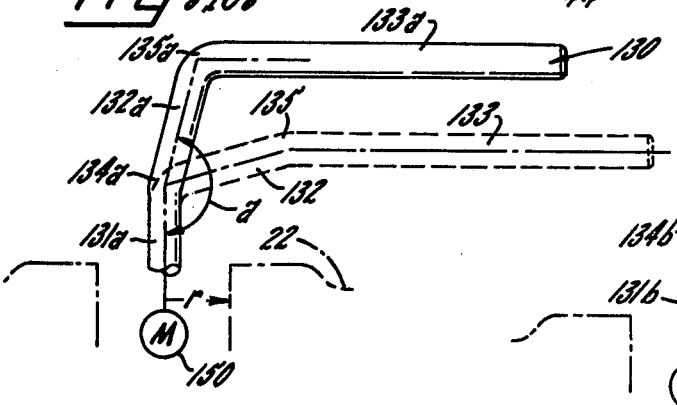

FIG. 10 is a profile view of an antenna of modified contour.

Figure 11:
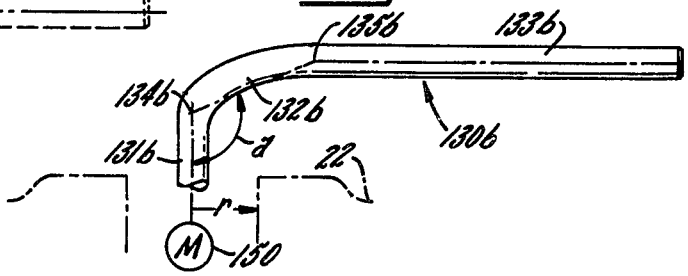

FIG. 11 is a profile view of a further modification of antenna.

Figure 12:
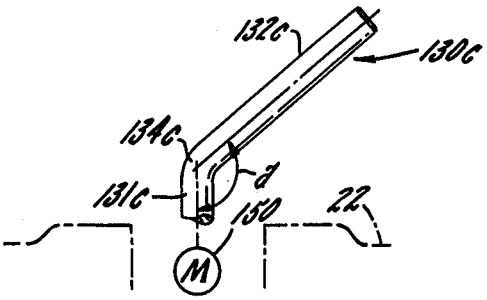
Figure 13:
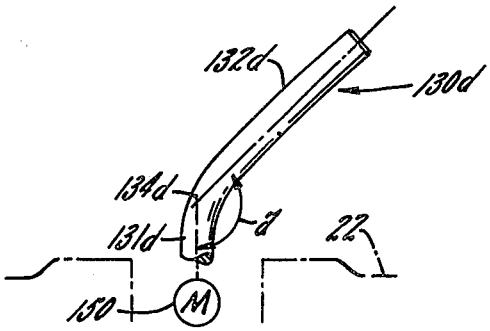

FIGS. 12 and 13 show profiles of antennas of dogleg shape in straight and curved versions.

While the invention has been described in connection with certain preferred embodiments, it will be understood that we do not intend to be limited to the particular embodiments shown and that we intend, on the contrary, to cover the various alternative and equivalent constructions included within the spirit and scope of the appended claims.

DETAILED DISCLOSURE

Turning to FIGS. 1 and 3 there is shown a typical free standing electric range to which the present invention has been applied. The range has an oven cavity 20 including a top wall 21, a bottom wall 22, side walls 23, 24 and a back wall 25. All of the walls are of "sandwich" construction formed of spaced sheets of metal with insulation, preferably in the form of glass wool, in between. Spaced downwardly a short distance from the top wall 21 is a heating element 27. A second heating element 28 is spaced a short distance above the bottom wall. The oven cavity is enclosed by a hinged door 30 having a gasket 31 which provides continuous and unbroken engagement with a land surface 32 on the range body. The gasket is of the type intended for shielding against escape of thermal and microwave energy, and its effect may be supplemented by use of a continuous choke 33 for which additional reference may be made to prior patents and technical publications. It will be assumed, as the discussion proceeds, that the range has wellknown provision for high temperature self-cleaning. Consequently, a latch is used having a latching control 34, with the mode of operation being selectable by a mode switch 35 at the top of the range. Within the oven cavity is a grid-type shelf 36 formed of metallic conductors in spaced parallel relation and extending horizontally over the entire area of the cavity. The shelf preferably has no central crossbar extending perpendicularly to the conductors. Metallic supports are used at the respective ends of the shelf; however, we employ no means to assure positive grounding of the supports. We have found with our feed system that arcing does not occur in the oven in spite of intermittent metal to metal contact, therefore, we neither intentionally ground rack and rack supports in the conventional manner nor intentionally insulate them.

Below the oven cavity 20, and of generally conforming shape, is a storage space having a closure 40 forming a portion of a drawer 41 mounted upon slides 42 and dimensioned to define a space 43 to the rear of the drawer. Extending horizontally at the bottom of the rear space 43 are supporting members 44.

In carrying out the present invention there is provided, at the rear of the storage space, a microwave module including a microwave power supply housing of generally rectangular shape having a magnetron, blower and associated circuitry, with a waveguide of rectangular section secured at its rear end to the top of the housing and having its front end extending forwardly cantilever-fashion under the bottom wall of the cavity. Referring to FIGS. 2–5 the microwave module, indicated generally at 50, is formed of a power supply housing 51 and a forwardly extending waveguide 52, the total width W and height H of the module being such that the module may be both inserted and withdrawn through the drawer opening.

The power supply housing 51 is of rectangular or box shape having top and bottom walls 53, 54, front and back walls 55, 56 and end walls 57. Each of the latter terminates in a mounting flange 58 which is secureable by suitable screw fasteners 59 in a seated position upon the supporting members 44.

Vertically mounted in the power supply housing is a conventional magnetron 70 (FIGS. 5 and 6) having cooling fin structure 71 and a glass or ceramic enclosure 72 for the antenna, which extends upwardly through a waveguide inlet 73 formed in the underside of the waveguide 52. Reference is made to prior patents for typical magnetron power and control circuits.

For the purpose of cooling the magnetron and ventilating the cavity during microwave usage, a blower 80 is provided having an inlet 81 and an outlet 82. The blower has a rotor 83 driven by a motor 84 and which sucks in air through an opening 85 in the rear of the housing. Air from the blower is conducted to the underside of the magnetron through a duct or connection 86 passing upwardly through the fins. The slightly warmed air, discharged at the top of the magnetron fin structure, flows into the housing to create a slight internal pressure. The bulk of the air is vented directly from the housing through several large openings includings a set of louvers 87 in the end wall of the housing, an auxiliary air opening 88 in the front wall, to which further reference will be made, and a rear discharge opening 89. The remaining space within the housing, in addition to that occupied by the blower and magnetron, will be understood to be taken up by the transformer and other necessary magnetron circuit components.

Turning attention next to the waveguide 52, it is preferably of rectangular cross section, secured at its rear end 91 to the top of the housing 51 and cantilevered forwardly so that its front end 92 underlies the central portion of the bottom wall 22 of the range cavity. The waveguide has top and bottom surfaces 93, 94, side surfaces 95, 96 and end surfaces 97, 98, thereby defining a tube leading from inlet 73 to an outlet 99. The outlet 99 is in axial register with an opening 100 (see especially FIG. 7) formed in the bottom wall 22 of the oven cavity. The opening 100 penetrates first and second bottom plates indicated at 101, 102, the space 103, in between, being filled with glass wool or similar thermal insulation.

For the purpose of coupling the outlet 99 of the waveguide with the cavity opening 100, a connector is provided in the form of a hollow-open-ended conductor or tube 110 which is telescoped into the opening 100 and which has a circular flange 111 at its upper end which seats on the bottom wall 22 of the cavity. More specifically, the flange seats upon an upraised annular land 112 which is formed in the plate 101 and which surrounds the opening 100, the land serving as a dam to prevent leakage of oven spills into the hollow conductor and thence into the waveguide.

For the purpose of sealing the hollow conductor 110 to the top of the waveguide in register with the outlet 99, a socket 115 is provided on the waveguide, the socket receiving the circular lower end 113 of the conductor. Such socket is defined by an annular mount 116 made of pressed metal and which is spot welded or otherwise securely fastened to the top wall 93 of the waveguide. At the root of the socket is a resilient conductive gasket 117 which may, for example, be formed of metal gauze.

For clamping the hollow conductor against the gause in the socket 115, a pair of clamping screws 121 are provided which extend through registering openings in the flange 111, with the threaded tips of the screws being received in tapped openings 122 in the mounting member 116.

The screws 121 are not, however, relied upon to keep the flange 111 tightly seated against the land. Preferably three additional screws 123 project through registering openings in the flange to engage tapped holes 124 in the land.

Spaced above the flange 111 is a mounting ring 125 which is supported upon short pedestals 126. The mounting ring 125 is secured by screws 127 which telescope through the flange and into registering tapped holes in the land.

Thus in assembling the device the flange is seated on the land and the screws 121 are tightened in the threaded holes 122 to seat the conductor 110, at its lower end, firmly against the socket 115 in the waveguide. The screws 123 are then tightened in place to doubly insure that the flange 111 is intimately seated against the land. Finally, the screws 127 are inserted into the mounting ring, and tightened.

Because of the cantilever extension of the waveguide 52 upon the housing 51, the waveguide occupies a nominal position from which it may be resiliently deflected without strain or damage to the module; for example, when the screws 121 are turned to draw the hollow conductor down into contact with the gasket 117, the end of the waveguide is simultaneously drawn upwardly through a small angle, resiliently twisting the module, until opposition to turning of the screws indicates that the hollow conductor 110 is fully bottomed. Seating of the hollow conductor to provide a tight joint at both ends is assured, notwithstanding dimensional variations, under production-line conditions, between the bottom 22 of the cavity and the plane of the supports 44 in the storage space.

In accordance with the present invention (FIG. 7) an antenna is mounted for rotation coaxially in the hollow conductor 110, the antenna being coupled at its lower end to a motor and drive train mounted upon the waveguide. As will be discussed in greater detail, the antenna, indicated at 130 has a straight shank portion 131 which is coaxially arranged in the conductor 110, a "transitional" portion 132 which is upwardly angled and a radial arm portion 133. In the preferred embodiment the antenna is formed by first and second abrupt bends 134, 135. The lower end of the antenna, indicated at 136 is keyed for reception in a rotatable mount 137 journaled in the bottom wall of the waveguide. To serve as a bearing for the upper end of the antenna, and to shield the upper end of the hollow conductor from food spills or other foreign matter, is a ceramic disc 140 supported within the amounting ring 125 on the posts 126 and having a central opening 141. The antenna is held captive in the central opening by a snap ring 142 which is in interfering relation with the underside of the disc.

It is one of the features of the present construction that the entire antenna and hollow conductor assembly may be conveniently removed, when service becomes necessary, from the inside of the oven cavity. By unscrewing the screws 127, the mounting ring 125, disc 140, and the antenna itself may be drawn clear of the conductor. Next, unscrewing the screws 121 frees the lower end of the conductor 110 from its seat on the waveguide, and unscrewing the screws 123 permits separation of the conductor flange 111 from the land 112 on the bottom wall of the oven so that the conductor may be lifted clear. The conductor assembly may be reinstalled by simply reversing the procedure.

For the purpose of rotating the mount 137, a small, clock-type driving motor 150 is provided having internal gear reduction. The motor is mounted on the top side of a motor mounting flange 151 which extends from the side of the waveguide. Pinned to the motor shaft is a first gear 152 located on the underside of the waveguide and which meshes with a second gear 153 which is pinned to a shaft 154 forming a part of the mount 137. The shaft is journaled in a bearing 155 of plastic or the like which occupies an opening 156 in the bottom of the waveguide, the opening being sufficiently small so that negligible leakage occurs. The motor gear reduction, and the ratio of gears 152, 153, in such that the antenna rotates at a low speed which may, for example, be on the order of 5 to 10 revolutions per minute, in any event providing a period of rotation which is less than the shortest cooking cycle.

In accordance with one of the features of the invention air passages are provided between the power supply housing so that a portion of air from the blower 80, and which cools the magnetron, flows through the waveguide and hollow conductor for ventilating the cavity when the blower is on, for final venting from the top of the cavity, with the same air path being utilized to set up flow of convected air during thermal cooking, and during self-cleaning, when the blower is off. Thus a pattern of small air passages 161 is provided in the wall of the waveguide, and between the housing and waveguide, as shown in FIG. 6, and a vent 162 is provided at the top of the cavity as shown in FIGS. 2 and 3. The path of the convected air is indicated by the dotted arrows 176 to distinguish over the forced air path which is indicated by the arrows which are solidly drawn. The passages 161, 162 are preferably sufficiently small, or screened, so that there is no leakage of microwave radiation either from the module or the cavity. Moreover, the passages 161 are so related, in area, to the main air discharge opening 87 and auxiliary air openings 88, 89 that the forced air flow through the cavity is limited to something on the order of three to eight cubic feet per minute. During thermal cooking, when the blower is turned off, the fact that the openings 85, 87 and 88 in the housing 51 are in a "low" position, below the bottom of the cavity, the fact that the waveguide 52 feeds air inwardly at the bottom of the cavity, and the fact that the vent 162 is in a "high" position at the top of the cavity, provides sufficient convection, on the order of 0.5 to 2.0 cfm., depending upon temperature, for both baking and self-cleaning operations. The path of the convected air is, however, sufficiently constricted so that the air flow for self-cleaning is below that which runs risk of explosion. It may be noted that while air flows outwardly of the air discharge openings 87, 88 during the blower mode, air flows inwardly, through the same openings, in the convection mode. The vent 162 may optionally be formed in the back or side walls at the very top of the cavity.

As a further feature combining both ventilation benefits and physical protection, a through shaped guard or shield is provided at the front of the power supply housing for surrounding and underlying the waveguide for protection of the waveguide and motor driving train against impact from articles stored in the drawer as well as for conducting forced air from the opening 88 in the housing along the waveguide for cooling both waveguide and motor. The guard 170 has a bottom wall 171, side walls 172, and a sloping front wall 173. The latter terminates in a flange 174 which is secured by screws **174*a* to the underside of the bottom plate 102 of the cavity. A second flange 175 at the rear of the guard is secured by screws 175*a* to the front wall 55 of the housing. It will be seen that such enclosure not only provides physical protection but defines a path for the pressurized air, the air flowing in the direction of arrow 176 from the opening 88 (see FIG. 6), making a U turn at the front end of the waveguide, and flowing backwardly along the sides of the waveguide for exit at the top of the housing. In this way air is usefully employed which would otherwise simply be discharged into the room. Because of the relatively small clearance requirements under the waveguide, the guard 170** does not appreciably subtract from the useful storage volume.

A rudimentary control circuit providing for use of either type of energy, or both, is illustrated in FIG. 9. The mode selector switch 35 is used having a first contact 181 for thermal heat, a second contact 182 which energizes the magnetron, and a third, or dual, contact 183 which turns on both of the energy sources. As indicated in this figure, the blower motor 84 and antenna motor 150 are turned on whenever the magnetron is turned on but are off at all other times. A fourth or "self-clean" position 184 is also provided, with the self-clean temperature being regulated by a thermostat 185.

In the case of normal cooking, the temperature is regulated by a conventional thermostat 186 in series with the heating elements. It will be understood that a practical control circuit is much more elaborate than that illustrated in FIG. 9, particularly as regards the safety features which are effective in the self-clean mode.

While the operation and easy replacement of the microwave system will be apparent from the foregoing, the following summary is offered: With the mode switch 35 in the "combined" mode, the heating elements establish a temperature set by the thermostat 186, and the magnetron, blower motor 84 and antenna motor 150 are all energized, with the wave from the antenna being swept throughout the cavity for equalized distribution of microwave energy, as will be described. A portion of the blower air feeding through air passages 161, and thence through the waveguide and hollow conductor, is discharged under the antenna supporting disc 140 into the cavity for eventual escape through the vent 162 at the top of the cavity. The bulk of the pressurized cooling air is discharged directly from the housing through the openings 87, 89 and, via opening 88, into the guard 170 which surrounds the waveguide and antenna motor so that all of the microwave components are kept at a safely low temperature regardless of the thermal temperature achieved in the cavity.

Because of the fact that all of the inlet openings for the convected air are well below the level of the bottom wall of the cavity, the convection pressure differential is sufficiently great to insure upward flow through the system even in the face of pressure developed by "auto ignition" as the soil is decomposed, so that there is no back-up of the decomposition products into the waveguide. Air follows the dotted air flow paths for convected passage of the air through the housing, waveguide and cavity with eventual venting at the top vent 162, without reliance upon the usual gap in the door gasket free of possibility of back-up or explosion.

In the event that servicing of the module is required, the hollow conductor assembly which communicates with the front end of the waveguide is loosened and retracted upwardly as previously described. Unscrewing of the screws 121 frees the front end of the waveguide from the oven structure. Subsequent removal of screws 174*a*, 175*a* which secure the trough 170 and screws 59 which hold the housing in seated position, permits the module to be pulled forwardly through the drawer opening. Electrical disconnection of the power supply module may be facilitated by a simple multiprong plug and socket. In a typical service call a new module is slipped in place by simply reversing the procedure.

ROTARY ANTENNA

The preferred form of antenna 130 disclosed in FIG. 7*a*, rotated at a relatively slow speed on the order of a few revolutions per minute, has been found to be highly effective in bringing about an equalized distribution of microwave energy throughout the cavity with relative freedom from the hot spots which usually characterize microwave cookery. The antenna is distinguished by a straight shank portion 131 and a radially extending arm portion 133 which is arranged approximately perpendicularly with respect to the shank, with an angled transitional portion 132 in between, the angled portion bearing an obtuse angle with respect to both the shank and the arm and having a length of at least the radius *r* of the hollow conductor for radiation of a guided wave in the cavity which sets up a plurality of radiation patterns.

In understanding the operation of the antenna it will, first of all, be appreciated that microwave energy is directly propagated from the waveguide into the cavity independently of antenna action, the resulting wave been referred to as the "inertial" wave. In addition, microwave energy which is coupled to the lower end of the antenna is guided along the antenna for radiation therefrom in the form of a "guided" wave. Where an L shaped or T shaped antenna is employed having an abrupt 90° bend, it is found that the bend constitutes a major discontinuity which actually prevents microwave energy from being converted to a guided wave. However, where the antenna, at point of exit, is bent on a more gradual basis, that is, is bent over a transitional region of at least the radius of the hollow conductor through which it projects into the cavity, the proportion of energy in the guided wave, as compared to the inertial wave, is increased and, in addition, the guided wave controls the pattern of radiation within the cavity. The increased number of radiation patterns, with continuous sweeping, inherently produces fewer hot spots than either the simpler, stationary mode patterns achieved using, for example, an antenna of the conventional monopole type, or a conventional antenna in combination with auxiliary stirring means.

In the preferred form of the invention, illustrated in FIG. 7*a*, the antenna has two concentrated bends 134, 135 to define its three portions. The radial arm portion 133 has a length which is preferably greater than the transitional portion to improve radiation patterns and/or facilitate impedance matching while maintaining a low profile. In practical cases the total radial length of the antenna may be on the order of 2.0 to 5.0 inches.

It is one of the features of the antenna that the bends 134, 135 are so related to one another that the antenna lies in the plane of the lower heating element 28. Although the antenna illustrated in FIG. 7*a* can be employed with conventionally formed U shaped heating elements whose surfaces are remote from the antenna, for those cases where the antenna tip overlies a heater surface, the preferred heater shape, as shown in FIG. 2*a*, is circumferentially distributed about the antenna path at a substantially constant radius so that the effect of the heating element 28 upon the radiated energy remains substantially constant throughout the rotational cycle.

Moreover, by spacing the radial portion 133 of the antenna, and the heating element 28, at the same relatively close spacing to the adjacent (bottom) wall 22, there is minimum encroachment upon the space within the cavity; in other words, a high degree of compactness is achieved. In a practical case, the spacing of the heating element and antenna from the adjacent wall is on the order of one and one-half inch. By keeping the antenna within the confines of the bottom heating element, and with the latter distributed as shown in FIG. 2*a*, the antenna itself does not take up any additional space within the cavity, making the utilization of space much more efficient than where a stirring device or conventional type of rotating antenna is employed.

It will be understood, however, that the invention is not limited to the exact profile illustrated in FIG. 7*a* and, if desired, the slightly higher profile, illustrated in FIG. 10, may be used. In this embodiment, in which corresponding reference numerals are used with addition of subscript *a* to indicate corresponding parts of the device, the included angle *a* at the first bend 134*a* is increased and the included angle at the second bend 135*a* is decreased. Preferably the angle *a* should be kept within the range of 105° to 165°, while the included angle at the second bend should be approximately (270° - *a*) to provide a low profile.

While it is preferred to form the antenna with concentrated bends, the antenna may be gradually bent or smoothly "faired" over the length of the transitional portion as indicated in FIG. 11, which corresponds to FIG. 7*a*, the same numerals being employed with addition of subscript *b*. Thus it will be noted that the transitional portional 132*b* has a length at least the radius *r* of the hollow conductor between the point 134*b* denoting the end of the shank and the point 135*b* denoting the beginning of the radial arm 133*b*.

The invention is not, however, limited to the embodiments illustrated in FIGS. 10 and 11 but includes the dogleg configuration set forth in FIGS. 12 and 13 where corresponding elements are denoted by the same reference numerals with addition of subscripts *c* and *d*, respectively. Thus referring to FIG. 12 the antenna has a straight shank portion 131*c* which is coaxially arranged in the hollow conductor, with a bend 134*c* which is substantially less than 90° to produce an included angle *a* which preferably lies within the range of 95° to 165°, the angled portion 132*c* being preferably at least equal in length to the radius of the hollow conductor. The structure of FIG. 13 corresponds to that of FIG. 12 except that the concentrated bend 134*c* has been replaced by a gradual bend to define an angled portion 132*d* having the same effective length.

In each of the illustrated embodiments of FIGS. 10 – 13 the use of an obtuse angle *a* to define a transitional portion 132 of dogleg configuration results in efficient guidance of energy from the shank to the radiating portions of the antenna with minimum electrical discontinuity thereby to control the ratio between the energy in the guided wave and that in the directly emitted, or inertial wave, with the guided wave being effectively superimposed upon the inertial wave and swept continuously throughout the cavity for improved energy distribution in the cavity with relative freedom from hot and cold spots. Thus the distribution is to be distinguished from that using a conventional monopole which tends to concentrate energy in a radial ring concentric with the monopole and the various types of "mushroom" antenna configurations which tend to distribute energy about the periphery while leaving a relatively large "hollow" energy region at the center of the cavity. It is found that using a rotated antenna of the above-described design the usual metal grid type of shelf employed in conventional electric ranges is effectively penetrated. It is one of the observed benefits of the invention, that arcing between metallic conductors placed within the oven cavity does not occur. Special precautions such as proper microwave grounding or insulated standoffs are not needed for metal grid shelves, shelve supports, or heating elements. This, while not fully understood, is attributed to the uniform energy distribution within the cavity.

It is one of the observed benefits of the present invention that a larger percentage of energy reaches the foodstuff along a direct radiation path than in conventional microwave ovens. Thus, using an electrically transparent vessel to contain the foodstuff, with the vessel supported in a generally central position, microwave energy received from the waveguide and from the rotating antenna creates even internal heat within the foodstuff, free of hot or cold spots as described. Such energy transfer is more uniform than that which occurs by reason of uncontrolled multiple reflection against the walls of the cavity, thereby reducing the time it takes to completely cook the foodstuff.

While it is preferred to use electrically transparent cooking vessels, another of the observed benefits of the described antenna is the fact that the cooking pattern does not seriously degrade when cooking with metallic utensils, nor do metallic cooking utensils cause adverse operating conditions harmful to magnetron operating life. Evidently the secondary reflections which occur also produce a more uniform energy distribution than that which occurs from conventional monopole or stirrer type microwave energy distribution systems.

Conventional sources of waveguide energy are highly sensitive to the dimensions and proportions of the cavity in which the energy is utilized. Thus, starting with a cavity of a certain dimension it has been necessary in the past to "tailor" the antenna and waveguide to the cavity and to make other adjustments including the position of point of feed in order to create a desired modal pattern. It is found, by contrast, that the present design of module and its associated antenna is largely independent of the size and dimensional proportions of the cavity so that the module and antenna assembly may be utilized by the manufacturers of different types, sizes and designs of oven cavities, free standing, built-in, and portable as well, on an O.E.M. basis, and with the only modification of the basic range structure being the provision of seating for the housing at a proper level and the use of a hollow conductor and clamping screws of appropriate length accommodated to the thickness of the lower insulated wall of the cavity. As a result almost any design of thermal oven may be modified to include microwave energy at a relatively small increment in cost, greatly expanding the market for microwave devices and indeed expanding the market for ranges in general.

While the above discussion has emphasized conversion of an electric range to microwave usage, it will be understood that the present microwave module is also applicable to conversion of gas ranges, although the latter will, of course, require a greater degree of modification. Consequently, the term "thermal element" will be understood as not being, necessarily, limited to an electric heating element. The term "storage space" has been used for convenience to apply to any available space adjacent the regular oven cavity.

Although it is preferred to seat the microwave power supply housing in a remote position in the storage space, it is conceivable that in a range design providing a wide oven having a limited front-to-back dimension, it may be more convenient to mount the microwave housing along the side of the storage space with some sacrifice in the width, but not length, of the drawer. Consequently, the term "back" used in connection with storage space shall be considered to be a relative term including both of the positions. The term "hollow conductor" which has been applied to the hollow tube 110 is also a general term applying to means defining any opening or passage between a waveguide and an oven cavity and the length of which depends upon the thickness of any insulating layer which may be provided. The term "waveguide" shall be considered to cover any conductor of wave energy from the magnetron for discharging microwave energy into, or which energizes an antenna in a shielded oven cavity. Thus the term waveguide as used herein includes a coaxial transmission line. The term "magnetron" refers to any source of high intensity microwave energy.

It is found that the structure described above produces a field which is so uniform and a result which is so predictable, that "formula cookery", based upon conventional cookbook instructions, is possible for the first time. Specifically, in the case of pastry and similar baked goods, the foodstuff, in normal quantity, is subjected to microwaves for a period of five minutes, after which baking is completed using thermal energy at the temperature, and in just one-half of the time, given in the conventional cookbook. In the case of other foods, both types of energy are applied from the beginning of the cycle and the total cooking time is reduced to one-quarter of that given in the cookbook.

What is claimed is:

1. In a combined microwave-thermal range, the combination comprising a frame having walls defining a rectangular oven cavity and a lower space, a door enclosing and sealing the front surface of the cavity against passage of air and microwave energy, a thermal element in the cavity, control means for operation of the thermal element at a normal temperature level for food preparation and at a high level for a self-cleaning mode, the walls of the cavity being insulated, the bottom wall of the cavity having an inlet opening, means defining a cavity air vent at the top of the cavity, a microwave power supply including a blower and a magnetron having cooling fins, the blower having a blower inlet for drawing in cooling air and an outlet for supplying such air under slight pressure to the cooling fins, a waveguide having an inlet connected to the magnetron and extending under the bottom wall of the cavity to terminate at an outlet, means for connecting the outlet of the waveguide to the inlet opening of the cavity for conduction of microwave energy into the cavity, means defining air passages of limited cross section for conducting air from the magnetron into the waveguide so that a portion of the pressurized air passes through the waveguide and into the cavity for ventilating the cavity when the magnetron and blower are turned on, the blower inlet being located at a lever below the bottom wall of the cavity so that when the blower and magnetron are turned off and the thermal element is turned on air is thermally convected from the blower inlet through the air passages into the waveguide and into the cavity for exiting through the cavity air vent notwithstanding the auto ignition pressure which exists in the cavity under high temperature self-cleaning conditions, the convention path of the air being sufficiently constricted so that air is convected in the self-cleaning mode at a level below that which is capable of producing an explosive reaction with the products of decomposition.

2. In a combined microwave-thermal range, the combination comprising a frame having walls defining a rectangular oven cavity and a lower space, a door enclosing and sealing the front surface of the cavity against passage of air and microwave energy, a thermal element in the cavity, control means for operation of the thermal element within a normal temperature range for food preparation and at a high temperature level for a self-cleaning mode, the walls of the cavity being insulated, the bottom wall of the cavity having an inlet opening, means defining a cavity air vent at the top of the cavity, a microwave power supply having a housing including a magnetron and blower, the blower having a blower inlet and arranged to draw in cooling air for supplying under slight pressure to the magnetron with discharge of at least a portion of the air into the housing to create slight pressure therein, a waveguide having an inlet connected to the magnetron and extending under the bottom wall of the cavity to terminate at an outlet, means for connecting the outlet of the waveguide to the inlet opening of the cavity for conduction of microwave energy into the cavity, means defining a pattern of small air passages from the housing to the waveguide so at least a portion of the pressurized air from the housing passes through the air passage and waveguide and into the cavity for ventilating the cavity when the magnetron and blower are turned on, all portions of the waveguide and housing including the blower inlet being located at a level below the bottom wall of the cavity so that when the blower and magnetron are turned off and the thermal element is turned on air is thermally convected from the blower inlet through the small air passages and waveguide into the cavity for exiting through the cavity air vent, the convection path of the air being sufficiently constricted so that air is convected in the self-cleaning mode at a level below that which is capable of producing an explosive reaction with the products of thermal decomposition.

3. In a combined microwave-thermal range, the combination comprising a frame having walls defining a rectangular oven cavity and a lower space, a door enclosing and sealing the front surface of the cavity against passage of air and microwave energy, a thermal element in the cavity, the walls of the cavity being insulated, the bottom wall of the cavity having an inlet opening, means defining a cavity air vent at the top of the cavity, a microwave power supply having a housing including a magnetron and blower, the blower having a blower inlet and arranged to draw in cooling air from outside the housing for supplying under slight pressure to the magnetron, the cooling air being discharged from the magnetron into the housing for creating internal pressure therein, a waveguide coupled to the magnetron and extending along the housing and under the bottom wall of the cavity, the waveguide having an outlet alined with the opening in the bottom wall of the cavity, a hollow open-ended conductor extending through the opening for coupling the outlet of the waveguide to the cavity, means for securing the upper end of the hollow conductor to the bottom wall of the cavity and the lower end of the conductor to the waveguide for conduction of microwave energy into the cavity, the wall of the waveguide having a pattern of small openings communicating with the housing so that a portion of the pressurized air from the blower and magnetron passes through the waveguide and hollow conductor into the cavity for ventilating the cavity when the magnetron and blower are turned on, the housing having a relatively large vent opening through which the pressurized air therefrom passes outwardly to reduce the internal pressure in the housing thereby to reduce the flow of air through the pattern of small openings and into the cavity to a predetermined low level, the blower inlet and large vent opening being located at a level below the bottom wall of the cavity so that when the blower and magnetron are turned off and the thermal element is turned on flow of air through the large vent opening is reversed in direction flowing inwardly through such vent opening into the housing and through the small openings via the waveguide into the cavity with final exiting through the cavity air vent.

4. In a combined microwave-thermal range, the combination comprising a frame having walls defining a rectangular oven cavity and a lower space, a door enclosing and sealing the front surface of the cavity against passage of air and microwave energy, a thermal element in the cavity, the walls of the cavity being insulated, the bottom wall of the cavity having an inlet opening, means defining a cavity air vent at the top of the cavity, a microwave power supply having a housing including a magnetron and blower, the blower having a blower inlet and arranged to draw in cooling air for supplying under slight pressure to the magnetron, a waveguide coupled to the magnetron and extending under the bottom wall of the cavity, the waveguide having an outlet alined with the opening in the bottom wall of the cavity, a hollow open-ended conductor extending through the opening for coupling the outlet of the waveguide to the cavity, means for securing the upper end of the hollow conductor to the bottom wall of the cavity and the lower end of the conductor to the waveguide for conduction of microwave energy into the cavity, an antenna element centered in the hollow conductor and projecting into the cavity for guiding microwave energy to the latter, means for conducting at least a portion of the pressurized air from the blower and magnetron through the waveguide and hollow conductor into the cavity for ventilating the cavity when the magnetron and blower are turned on, the blower inlet being located at a level below the bottom wall of the cavity so that when the blower and magnetron are turned off and the thermal element is turned on air is convected through the blower inlet, waveguide and hollow conductor into the cavity for exiting through the cavity air vent at the top thereof.

5. In a combined microwave-thermal range, the combination comprising a frame having walls defining a rectangular oven cavity and a lower space of conforming shape, a door enclosing and sealing the front surface of the cavity against passage of air and microwave energy, a thermal element in the cavity, control means for operation of the thermal element within a normal temperature range for food preparation and at a high temperature level for a self-cleaning mode, the walls of the cavity being insulated, the bottom wall of the cavity having an inlet opening, means defining a cavity air vent at the top of the cavity, a microwave power supply having a housing including a magnetron and blower, the blower having a blower inlet and arranged to draw in cooling air for discharge under slight pressure to the magnetron, a waveguide having an inlet connected to the magnetron and extending under the bottom wall of the cavity to terminate at an outlet, means for connecting the outlet of the waveguide to the inlet opening of the cavity for conduction of microwave energy into the cavity, the waveguide being open to passage of cooling air from the magnetron so at least a portion of the pressurized air from the blower and magnetron passes through the waveguide and into the cavity for ventilating the cavity when the magnetron and blower are turned on, the blower inlet being located at a level below the bottom wall of the cavity so that when the blower and magnetron are turned off and the thermal element is turned on air is thermally convected through the blower inlet, magnetron, and waveguide into the cavity for final exit through the cavity air vent at the top thereof, the air passage through the blower, magnetron and waveguide being sufficiently constricted so that the air is convected in the self-cleaning mode at a level below that which is capable of producing an explosive reaction with the products of thermal decomposition.

6. The combination as claimed in claim 5 in which the constriction in the air passage through the blower inlet, magnetron and waveguide is in the form of a pattern of small openings in the wall of the waveguide and in communication with the housing, the openings being of sufficiently small dimension so as to preclude the escape of microwave energy therethrough.

7. The combination as claimed in claim 6 in which the openings in the wall of the waveguide and the vent opening are sufficiently limited in total area as to limit the flow of air for microwave cookery to within the range of three to eight c.f.m. when the blower is on and to reduce the flow of convected air under baking and self-cleaning conditions to within the range of 0.5 to 2 c.f.m.

* * * * *

Disclaimer 4,028,520.—*Sumner H. Torrey,* West Lafayette, Ind. AIR FLOW SYSTEM FOR COMMON CAVITY MICROWAVE OVEN. Patent dated June 7, 1977. Disclaimer filed Feb. 13, 1984, by the assignee, *Roper Corp.*

Hereby enters this disclaimer to claim 1 of said patent.

[*Official Gazette April 17, 1984.*]